US005192235A

United States Patent [19]

Dunham et al.

[11] Patent Number: 5,192,235

[45] Date of Patent: Mar. 9, 1993

[54] OUTBOARD MOTOR VIBRATION ISOLATION SYSTEM INCLUDING IMPROVED RUBBER MOUNT

[75] Inventors: William D. Dunham; John C. Heiti, both of Waukegan, Ill.

[73] Assignee: Outboard Marine Corporation, Waukegan, Ill.

[21] Appl. No.: 782,545

[22] Filed: Oct. 25, 1991

[51] Int. Cl.[5] ..... B63H 21/26

[52] U.S. Cl. ..... 440/52; 248/638; 403/225; 440/900

[58] Field of Search ..... 440/52, 111, 900; 248/634, 635, 636, 637, 638, 639, 640, 641, 642, 643; 267/141.2; 411/75, 80; 403/220, 225

[56] References Cited

U.S. PATENT DOCUMENTS

| | | | |
|---|---|---|---|
| 1,778,992 | 10/1930 | Wulfert . | |
| 1,792,872 | 2/1931 | Saurer . | |
| 1,844,755 | 2/1932 | Geyer . | |
| 1,964,432 | 6/1934 | Geyer . | |
| 2,706,126 | 4/1955 | Thiry . | |
| 2,740,368 | 4/1956 | Irgens et al. . | |
| 2,781,990 | 2/1957 | Via . | |
| 2,911,936 | 11/1959 | Kiekhaefer . | |
| 2,916,007 | 12/1959 | Kiekhaefer . | |
| 3,002,489 | 10/1961 | Watkins . | |
| 3,127,866 | 4/1964 | Mohr . | |
| 3,358,668 | 12/1967 | Post et al. . | |
| 3,599,594 | 8/1971 | Taipale | 115/17 |
| 3,750,615 | 8/1973 | Haft et al. | 115/18 |
| 3,782,321 | 1/1974 | Ellingsen | 115/17 |
| 3,834,344 | 9/1974 | Yoshino | 115/34 |
| 3,845,923 | 11/1974 | Atkinson | 440/52 |
| 3,929,089 | 12/1975 | Lambrecht et al. | 440/52 |
| 3,934,537 | 1/1976 | Hall | 115/17 |
| 3,951,477 | 4/1976 | Townshend | 308/22 |
| 4,425,813 | 1/1984 | Wadensten | 74/87 |
| 4,452,332 | 6/1984 | Ping et al. | 180/312 |
| 4,507,090 | 3/1985 | Kobayashi et al. | 440/52 |
| 4,546,848 | 10/1985 | Iijima et al. | 180/312 |
| 4,625,939 | 12/1986 | Bergelt | 248/638 |
| 4,632,662 | 12/1986 | Handa | 440/52 |
| 4,664,636 | 5/1987 | Blickle et al. | 440/52 |
| 4,666,412 | 5/1987 | Rawlings | 440/111 |
| 4,714,132 | 12/1987 | Hattori et al. | 180/312 |
| 4,936,394 | 6/1990 | Ohtsu | 173/162.2 |
| 4,966,567 | 10/1990 | Breckenfeld et al. | 440/89 |
| 4,979,918 | 12/1990 | Breckenfeld et al. | 440/52 |
| 5,083,949 | 1/1992 | Breckenfeld et al. | 440/52 |

FOREIGN PATENT DOCUMENTS 57-126794 6/1982 Japan .

*Primary Examiner*—Jesus D. Sotelo
*Assistant Examiner*—Stephen P. Avila
*Attorney, Agent, or Firm*—Michael, Best & Friedrich

[57] ABSTRACT

A marine propulsion device comprising a propulsion unit including a wall defining a cavity, and a rubber mount which is located in the cavity and which includes an annular outer shell having an outer surface engaging the wall and an inner surface defining an axially extending bore having a minimum diameter, an inner core extending through the bore, being adapted to be connected to a kingpin, and including an end core portion having a diameter less than the minimum diameter, and an opposite end core portion having a diameter greater than the minimum diameter, and a resilient member extending between the outer shell surface and the inner core.

19 Claims, 1 Drawing Sheet

OUTBOARD MOTOR VIBRATION ISOLATION SYSTEM INCLUDING IMPROVED RUBBER MOUNT

FIELD OF THE INVENTION

The invention relates generally to marine propulsion devices, and more particularly to motor mounting members used in vibration isolation and propulsion unit supporting systems for marine propulsion devices.

REFERENCE TO PRIOR ART

A conventional outboard motor includes a propulsion unit and a mounting assembly for supporting the propulsion unit on the transom of a boat. The mounting assembly typically includes a transom bracket fixed to the boat transom, a swivel bracket mounted on the transom bracket and a kingpin supported by the swivel bracket for pivotal movement relative to the swivel bracket about a generally vertical steering axis. The propulsion unit is mounted on the kingpin via a pair of "rubber mounts" which vibrationally isolate the propulsion unit from the mounting assembly.

The rubber mounts each typically include a cylindrical outer shell that has an axial bore and that is fixed directly to the propulsion unit, a cylindrical inner shell received in the axial bore and connected to the kingpin, and an intervening resilient member bonded between the inner and outer shells. In some arrangements additional hardware is secured to the inner shell to prevent excessive forward movement of the inner shell relative to the outer shell during hard acceleration of the outboard motor.

Attention is directed to the following U.S. Pat. Nos.

| Inventor | U.S. Pat. No. | Issued |
|---|---|---|
| Wulfert | 1,778,992 | October 21, 1930 |
| Saurer | 1,792,872 | February 17, 1931 |
| Geyer, et al. | 1,844,755 | February 9, 1932 |
| Geyer | 1,964,432 | June 26, 1934 |
| Thiry | 2,706,126 | April 12, 1955 |
| Irgens, et al. | 2,740,368 | April 3, 1956 |
| Via | 2,781,990 | February 19, 1957 |
| Kiekhaefer | 2,911,936 | November 10, 1959 |
| Kiekhaefer | 2,916,007 | December 8, 1959 |
| Watkins | 3,002,489 | October 3, 1961 |
| Mohr | 3,127,866 | April 7, 1964 |
| Post | 3,358,668 | December 19, 1967 |
| Taipale | 3,599,594 | August 17, 1971 |
| Haft, et al. | 3,750,615 | August 7, 1973 |
| Ellingsen | 3,782,321 | January 1, 1974 |
| Yoshino | 3,834,344 | September 10, 1974 |
| Hall | 3,934,537 | January 27, 1976 |
| Townshend | 3,951,477 | April 20, 1976 |
| Wadensten | 4,425,813 | January 17, 1984 |
| Ping, et al. | 4,452,332 | June 5, 1984 |
| Kobayashi, et al. | 4,507,090 | March 26, 1985 |
| Iijima, et al. | 4,546,848 | October 15, 1985 |
| Bergelt | 4,625,939 | December 2, 1986 |
| Rawlings | 4,666,412 | May 19, 1987 |
| Hattori, et al. | 4,714,132 | December 22, 1987 |
| Ohtsu | 4,936,394 | June 26, 1990 |
| Breckenfeld et al. | 4,966,567 | October 30, 1990 |
| Breckenfeld et al. | 4,979,918 | December 25, 1990 |

Attention is also directed to Japanese Patent No. 57-126794 issued Aug. 6, 1982 to Kobayashi.

SUMMARY OF THE INVENTION

The invention provides a marine propulsion device comprising a propulsion unit including wall means defining a cavity, and a mounting member which is located in the cavity and which includes an annular outer shell including an outer surface engaging the wall means and an inner surface defining an axially extending bore having a minimum diameter, an inner core extending through the bore, being adapted to be connected to a kingpin, and including an end core portion having a diameter less than the minimum diameter, and an opposite end core portion having a diameter greater than the minimum diameter, and resilient means extending between the outer shell surface and the inner core.

The invention also provides a marine propulsion device comprising a propulsion unit including wall means defining a cavity, and a mounting member which is located in the cavity and which includes an annular outer shell engaging the wall means and including an inner surface defining an axially extending bore, an inner core extending through the bore and being adapted to be connected to a kingpin, and resilient means for connecting the inner core to the outer shell such that the resilient means is under compression in response to opposing axial forces on the inner core and the outer shell.

The invention also provides a marine propulsion device comprising a propulsion unit including a propeller shaft, wall means defining a forwardly opening cavity, a mounting member which is located in the cavity and which includes an annular outer shell including an outer surface engaging the wall means and an inner surface defining an axially extending bore, the bore including a central surface portion having a minimum diameter, and forward and rearward surface portions each converging inwardly to the central surface portion, the forward and rearward surface portions respectively defining a forward frustoconical bore section and a rearward frustoconical bore section, an inner core extending through the bore, being adapted to be connected to a kingpin, and including a central core portion encircled by the central surface portion, a forward end core portion having a diameter less than the minimum diameter, a rearward end core portion having a diameter greater than the minimum diameter, extending externally of the bore, and providing interference between the outer shell and the inner core to prevent removal of the inner core from the outer shell in response to forces tending to move the inner core in a forward axial direction relative to the outer shell, a forward conical portion which converges from the forward end core portion to the central core portion and which is housed within the forward frustoconical bore section, and a rearward conical portion which converges from the rearward end core portion to the central core portion and which is housed within the rearward frustoconical bore section, and a resilient member which is bonded between the inner core and the inner surface of the outer shell and which includes a first portion disposed between the forward surface portion of the inner surface and the forward conical portion of the inner core, a second portion disposed between the rearward surface portion of the inner surface and the rearward conical portion of the inner core, each of the first and second portions of the resilient member being deformable in both shear and compression responsive to axial movement of the inner core relative to the outer shell, and a third portion disposed between the central surface portion of the inner surface and the central core portion, the third portion being deformable in shear responsive to axial movement of the inner core relative to the outer shell, and means for securing the mounting member in the cavity.

A principal feature of the invention is the provision of an improved rubber mount which vibrationally isolates the motor mounting assembly from the propulsion unit and which is configured to resist axial movement of the inner core relative to the outer shell by placing portions of the intervening resilient member in compression. The rubber mount is also configured to provide positive interference between the outer shell and the core to prevent excessive movement in one axial direction of the core relative to the shell to thereby eliminate extraneous hardware required to otherwise provide this stop.

Other features and advantages of the invention will become apparent to those skilled in the art upon review of the following detailed description, claims and drawings.

Figure 1:
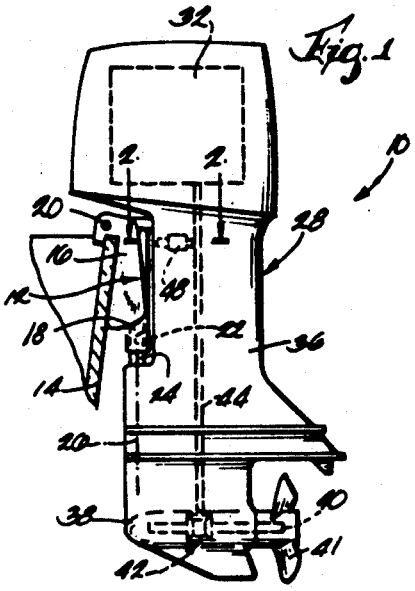
FIG. 1 is a side elevational view of a marine propulsion device embodying various of the features of the invention.

Before one embodiment of the invention is explained in detail, it is to be understood that the invention is not limited in its application to the details of construction or the arrangement of components set forth in the following description or illustrated in the drawings. The invention is capable of other embodiments and, of being practiced or being carried out in various ways. Also, it is to be understood that the phraseology and terminology used herein is for the purpose of description and should not be regarded as limiting.

GENERAL DESCRIPTION

Illustrated in the drawings is a marine propulsion device in the form of an outboard motor 10. As shown in FIG. 1, the outboard motor 10 comprises a mounting assembly 12 mounted on the transom 14 of a boat. While various suitable mounting assemblies can be employed, in the illustrated arrangement the mounting assembly 12 includes a transom bracket 16 fixed to the boat transom 14 and a swivel bracket 18 mounted on the transom bracket 16 for pivotal movement of the swivel bracket 18 relative to the transom bracket 16 about a generally horizontal tilt axis 20. The swivel bracket 18 is provided with a vertically extending bore 22 in which a kingpin 24 is supported for pivotal movement about a generally vertical steering axis 26.

Figure 2:
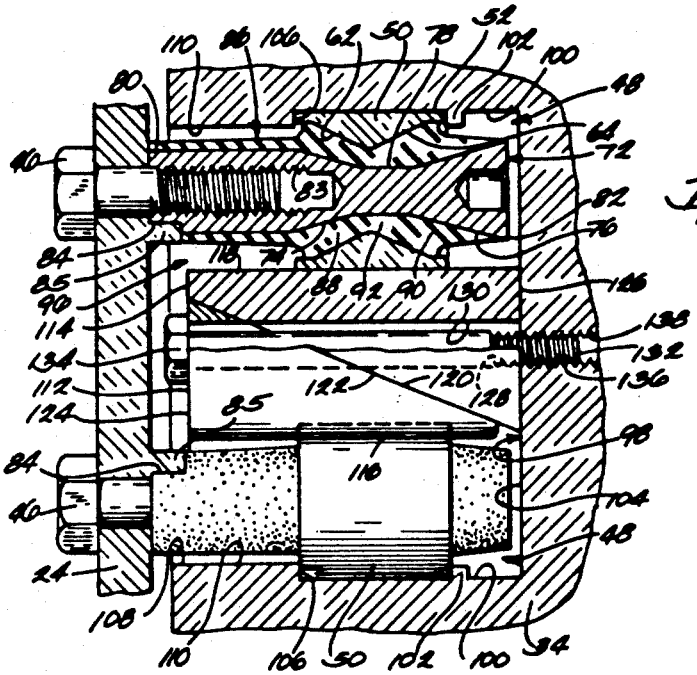
FIG. 2 is an enlarged fragmentary and partially sectional view taken along line 2—2 of FIG. 1.

The outboard motor 10 also comprises a propulsion unit 28 including an internal combustion engine 32 having an engine block 34 (see FIG. 2). The propulsion unit 28 also includes a drive shaft housing 36 having an upper end fixed to the engine block 34 and a lower end fixed to a gear case 38. The gear case 38 rotatably supports a propeller shaft 40 which has on the rear end thereof a propeller 41 and which is connected via a transmission 42 to a drive shaft 44 that extends through the drive shaft housing 36 and that is driven by the engine 32.

The outboard motor 10 also comprises means for mounting the propulsion unit 28 on the kingpin 24 for tilting movement in common with the swivel bracket 18 and for pivotal steering movement relative to the swivel bracket 18 about the steering axis 26. While various mounting means can be employed, in the illustrated construction the mounting means includes a pair of arms or bolts 46 (see FIG. 2) which extend rearwardly from the upper end of the kingpin 24 and which are connected to a pair of motor mounting members or rubber mounts 48. As will be more fully explained hereinafter, the rubber mounts 48 are secured to the propulsion unit 28 to support the propulsion unit 28 from the mounting assembly 12 and to vibrationally isolate the propulsion unit 28 from the mounting assembly 12, and therefore from the boat transom 14.

Figure 4:
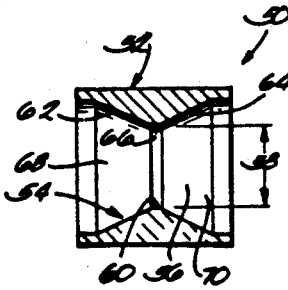
FIG. 4 is a sectional view of the outer shell shown in FIG. 3.
Figure 3:
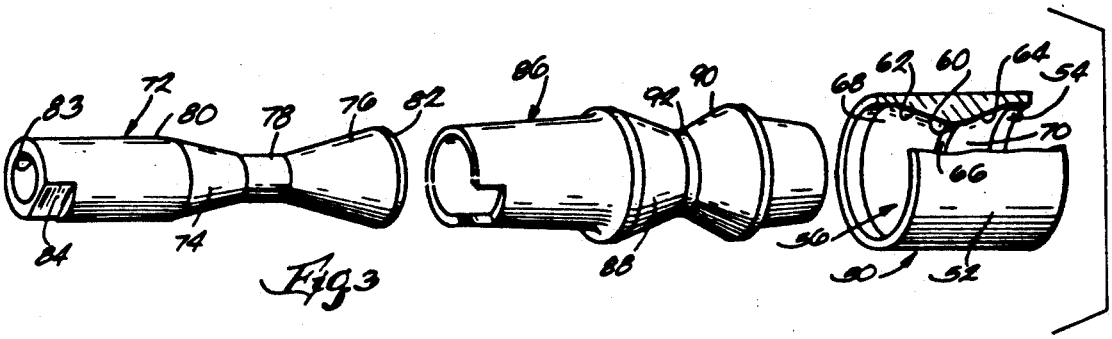
FIG. 3 is an enlarged and partially cut-away exploded perspective view of one of the motor mounting members shown in FIG. 2.

While the rubber mounts 48 can each be variously configured without departing from the spirit of the invention, in the illustrated construction the rubber mounts 48 are generally identical (see FIG. 2). Referring to FIGS. 2 through 4, each of the rubber mounts 48 includes an annular outer shell 50 which is suitably secured to the propulsion unit 28 as explained below. The outer shell 50 includes a generally cylindrical outer surface 52 and an inner surface 54 defining an axially extending bore 56 and having a minimum inner diameter 58. More particularly, the inner surface 54 includes a central surface portion 60 having the minimum diameter 58 and forward and rearward surface portions 62 and 64 which each converge inwardly to the central surface portion 60. As shown in FIGS. 3 and 4, the inner surface portions 60, 62 and 64 respectively define a cylindrical central bore section 66, a forward frustoconical bore section 68, and a rearward frustoconical bore section 70. While the outer shell 50 can be made of various materials, it is preferred that the shell 50 be fabricated from metal, and particularly aluminum.

Each of the rubber mounts 48 also includes a central or inner core 72 which is preferably made of metal such as steel and which extends through the bore 56 in spaced relation to the inner surface 54 of the outer shell 50. In the illustrated arrangement, the core 72 is generally configured to conform to the contour of the inner surface 54 when inserted into the bore 56. In particular, the core 72 includes forward and rearward generally conical portions 74 and 76 converging inwardly to a cylindrical central portion 78 from opposite forward and rearward cylindrical end portions 80 and 82. The conical portions 74 and 76 are housed in the forward and rearward frustoconical bore sections 68 and 70, respectively, and the central portion 78 is housed in the bore section 66. As shown in FIG. 2, the center (from left to right in FIG. 2) of the central portion 78 is preferably offset rearwardly (to the right in FIG. 2) relative to the center of the bore relation 66. The forward end portion 80 of the core 72 has a diameter which is smaller than the minimum diameter 58 to facilitate insertion of the core 72 into the bore 56. The rearward end portion 82 of the core 72 has a diameter which is larger than the minimum diameter 58 to restrict axial movement of the core 72 relative to the outer shell 50 for reasons more fully explained below.

To facilitate connection of the bolts 46 to the rubber mounts 48, the forward end portion 80 of each core 72 is provided with an axially extending threaded aperture 83 and a notch 84. The notch 84 of each rubber mount 48 abuts a tab 85 on the kingpin 24 to restrict movement of that rubber mount 48 when one of the bolts 46 is threaded into the aperture 83 to fixedly connect the kingpin 24 to the rubber mounts 48. In a like manner, the engagement between the notch 84 and the tab 85 also facilitates disconnection of the bolt 46 from the rubber mount 48. This is especially true if, through wear or adverse environmental conditions, the resilient means discussed below degrades so as to permit the inner core 72 to rotate relative to the outer shell 50.

To vibrationally isolate the mounting assembly 12 from the propulsion unit 28, each rubber mount 48 includes resilient means between the core 72 and the outer shell 50 for damping or resisting relative movement therebetween and to absorb engine vibration. In the illustrated arrangement, such resilient means connects the core 72 to the shell 50 so that the resilient means is under compression in response to opposing axial forces on the core 72 and the shell 50. The resilient means includes an elastomeric member 86 bonded between the core 72 and the inner surface 54 of the outer shell 50. The elastomeric member 86 is positioned between the core 72 and the outer shell 50 so as to respond to relative axial movement between the outer shell 50 and the core 72 by deforming in the compressive mode to a greater degree than occurs in prior rubber mounts which resist such relative movement through shear deformation.

More specifically, the elastomeric member 86 includes a first or forward portion 88 disposed between the forward surface portion 62 of the outer shell 50 and the forward conical portion 74 of the core 72, a second or rearward portion 90 disposed between the rearward surface portion 64 of the outer shell 50 and the rearward conical portion 76 of the core 72, and a third or central portion 92 disposed between the central surface portion 60 of the outer shell 50 and the central core portion 78. The forward and rearward conical portions 74 and 76 of the core 72 and the forward and rearward surface portions 62 and 64 of the outer shell 50 combine to deform the forward and rearward portions 88 and 90 of the elastomeric member 86 in both shear and compression responsive to axial movement of the core 72 relative to the shell 50. By deforming at least partially in compression, the elastomeric member 86 avoids excessive shear deformation. The central portion 92 of the elastomeric member 86 is subjected primarily to shear deformation in response to relative axial movement between the outer shell 50 and the core 72.

To assemble the rubber mount 48, the forward end portion 80 of the core 72 is inserted through the shell bore 56. Thereafter, the elastomeric member 86 is installed, preferably by molding, around the core 72 and into the bore space between the core 72 and the inner surface 54 of the outer shell 50.

As mentioned above, the mounting means is provided with means for securing the rubber mounts 48 to the propulsion unit 28. While various suitable securing means can be employed, in the disclosed construction this arrangement is generally the same as the arrangement described in U.S. Pat. No. 4,979,918, which issued Dec. 25, 1990 to Breckenfeld et al. and which is herein incorporated by reference. Thus, the securing means includes the provision of a cavity 96 in the propulsion unit 28. As shown in FIG. 2, the cavity 96 is formed in the engine block 34 and is defined by interior wall means 98. The wall means 98 includes spaced side walls 100 which are preferably semi-cylindrical and which are laterally spaced apart at a distance greater than twice the diameter of the outer shells 50. The wall means 98 also includes intermediate shoulders 102 projecting inwardly of the cavity 96 from the side walls 100. The wall means further includes a rear wall 104 and a front wall 106.

To facilitate insertion of the rubber mounts 48 into the cavity 96, an access or entry opening 108 is provided in the engine block 34 from the exterior of the propulsion unit 28 and communicates with the cavity 96 to afford entry of at least one rubber mount 48 into the cavity 96. In this regard, the opening 108 has a lateral dimension which is greater than the diameters of the outer shells 50 but less than the distance between the side walls 100 of the cavity 96, thereby forming the front wall 106 with shoulders or flanges 110 extending forwardly from the front end of the semi-cylindrical side walls 100.

The opening 108 also has a vertical extent greater than the diameter of the outer shells 50 so that the rubber mounts 48 can be inserted through the opening 108 and into the cavity 96. The rubber mounts 48 can thereafter be respectively located in nested, snug engagement with the semi-cylindrical side walls 100 and between the shoulders 102 and the flanges 110.

The means for securing the rubber mounts 48 to the propulsion unit 28 also includes means insertable through the opening 108 and into the cavity 96, securable to the propulsion unit 28, and engageable with the rubber mounts 48 for fixedly securing the rubber mounts 48 to the propulsion unit 28 and between the insertable means and the interior wall means 98 of the cavity 96. Such means is disclosed in U.S. Pat. No. 4,979,918 and includes a pair of wedge-shaped front and rear blocks 112 and 114. The front and rear blocks 112 and 114 respectively include side walls or surfaces 116 and 118 which are preferably concavely semi-cylindrical and which are adapted to snugly engage the outer shells 50. Also, the blocks 112 and 114 respectively include inclined surfaces 120 and 122 which are slideably engaged with each other. In addition, the front block 112 includes a front end wall 124 and the rear block 114 includes a rear end wall 126 adapted to engage the rear wall 104 of the cavity 96.

Means are also provided for releaseably securing the blocks 112 and 114 to the propulsion unit 28 and for displacing the blocks 112 and 114 relative to each other and along the inclined surfaces 120 and 122 to, in effect, outwardly displace the concave side surfaces 116 and 118 away from each other and into snug engagement with the outer shells 50 of the rubber mounts 48. This secures the outer shells 50 against the semi-cylindrical side walls 100 of the cavity 96 and between the shoulders 106 and the flanges 110, thereby fixedly locating the rubber mounts 48 relative to the propulsion unit 28. Such means for releaseably securing the blocks 112 and 114 and displacing the blocks 112 and 114 relative to each other includes the inclined or wedged relation of the inclined surfaces 120 and 122, and respective cooperating and aligned apertures 128 and 130 in the blocks 112 and 114, together with a bolt 132. The bolt 132 has an enlarged head 134 which engages the front end wall 124 of the front block 112, and a shank 136 which extends through the aligned apertures 128 and 130 in the blocks 112 and 114 and which is threaded into a hole 138 in the rear wall 102 of the cavity 96. Consequently, axial movement of the head 134 toward the rear wall 102 in response to rotation of the bolt 132 seats the rear end wall 126 of the rear block 114 against the rear wall 102 and slides the front block 112 rearwardly along the inclined surface 122 of the rear block 114, thereby outwardly displacing the blocks 112 and 114 relative to each other and into engagement with the outer shells 50 of the rubber mounts 48 so as to tightly secure the rubber mounts 48 to the propulsion unit 28.

The means for mounting the propulsion unit 28 on the kingpin 24 also includes means such as the rubber mounts 48 for securing the lower end of the kingpin 24 to the drive shaft housing 36, although other securing means could also be employed.

In assembling the propulsion unit 28 on the mounting assembly 12, the rubber mounts 48 are first inserted into the cavity 96 through the opening 108. This is followed by insertion of the rear block 114 and then the forward block 112 into the cavity 96, and by insertion of the bolt 132 through the apertures 128 and 130 to threadingly engage the bolt 132 in the rear wall 102. Axial movement of the bolt 132 in response to increasing threaded engagement causes the front block 112 to slide on the rear block 114 and causes the blocks 112 and 114 to move laterally outwardly relative to each other, thereby capturing the outer shells 50 of the rubber mounts 48 between the side walls 100 of the cavity 96 and the concave surfaces 116 and 118 of the blocks 112 and 114. The bolts 46 extending from the kingpin 24 are thereafter threaded into the inner cores 72 of the rubber mounts 48.

Advantageously, the rubber mounts 48 more efficiently isolate the mounting assembly 12 from the vibrations and movement of the propulsion unit 28. This is accomplished by configuring the rubber mount 48 to absorb a greater degree of relative axial movement between the outer shell 50 and the inner core 72 through compressive deformation of the elastomeric member 86. By configuring the rubber mount 48 in this way, shear deformation of the elastomeric member 86 is reduced and excessive relative axial movement of the inner core 72 relative to the outer shell 50 is met with increasing resistance of the elastomeric member 86 to deformation.

Additionally, the rearward end portion 82 of the rubber mount 48 is enlarged to provide a positive stop to limit movement of the inner core 72 in the forward axial direction relative to the outer shell 50 in response to forces tending to move the core 72. This feature is provided to avoid excessive deformation of the elastomeric member 86, such as can occur during hard acceleration of the outboard motor 10. Thus, the rubber mounts 48 avoid the need for extraneous hardware to limit such excessive axial movement of the core 72 relative to the shell 50.

Various features of the invention are set forth in the following claims.

We claim:

1. A marine propulsion device comprising a propulsion unit including wall means defining a cavity, and a mounting member which is located in said cavity and which includes an annular outer shell including an outer surface engaging said wall means and an inner surface defining an axially extending bore having a minimum diameter, an inner core extending through said bore, being adapted to be connected to a kingpin, and including an end core portion having a diameter less than said minimum diameter, and an opposite end core portion having a diameter greater than said minimum diameter, and resilient means extending between said outer shell surface and said inner core.

2. A marine propulsion device as set forth in claim 1 wherein said inner surface includes a central surface portion having said minimum diameter, and wherein said inner core includes a central core portion located between said end portions and encircled by said central surface portion.

3. A marine propulsion device as set forth in claim 2 wherein said inner surface includes forward and rearward surface portions each converging inwardly to said central surface portion, said forward and rearward surface portions respectively defining a forward frustoconical bore section and a rearward frustoconical bore section, and wherein said inner core includes a forward conical portion converging from said first-mentioned end core portion to said central core portion and housed within said forward frustoconical bore section, and a rearward conical portion converging from the other of said end core portions to said central core portion and housed within said rearward frustoconical bore section.

4. A marine propulsion device as set forth in claim 1 wherein said cavity opens forwardly, and wherein said first-mentioned end portion of said inner core is located forwardly of said opposite end portion.

5. A marine propulsion device as set forth in claim 1 and further comprising means for securing said mounting member in said cavity.

6. A marine propulsion device as set forth in claim 1 wherein said second-mentioned end core portion extends externally of said bore and provides interference between said outer shell and said inner core to prevent removal of said inner core from said outer shell in response to forces tending to move said inner core in a forward axial direction relative to said outer shell.

7. A marine propulsion device as set forth in claim 1 wherein said resilient means includes an elastomeric member bonded between said inner core and said inner surface of said outer shell.

8. A marine propulsion device as set forth in claim 1 wherein said resilient means includes an elastomeric member which is disposed within said bore and which deforms in both shear and compression responsive to axial movement of said inner core relative to said outer shell.

9. A marine propulsion device as set forth in claim 8 wherein said resilient means includes an elastomeric member having a first portion disposed between said inner core and said forward surface portion of said inner surface, a second portion disposed between said inner core and said rearward surface portion of said inner surface, each of said first and second portions of said elastomeric member being deformable in both shear and compression responsive to axial movement of said inner core relative to said outer shell, and a third portion disposed between said central core portion and said central surface portion of said inner surface and being deformable in shear responsive to axial movement of said inner core relative to said outer shell.

10. A marine propulsion device as set forth in claim 1 wherein said inner surface includes a central surface portion having said inner diameter, and opposite end surface portions each converging inwardly to said central surface portion, and wherein said core includes a central core portion which is between said opposite end core portions, which has a diameter less than said diameter of said first-mentioned end core portion, and which is encircled by said central surface portion.

11. A marine propulsion device as set forth in claim 10 wherein said resilient means includes an elastomeric member having a first portion disposed between one of said end surface portions and said inner core, and a second portion disposed between the other of said end surface portions and said inner core, each of said first and second portions of said elastomeric member being deformable in both shear and compression responsive to axial movement of said inner core relative to said inner shell.

12. A marine propulsion device as set forth in claim 1 wherein said inner core includes a notched portion adapted to engage the kingpin to restrict rotation of said inner core relative to said kingpin.

13. A marine propulsion device as set forth in claim 1 wherein said propulsion unit includes a propeller shaft and an engine drivingly connected to said propeller shaft.

14. A marine propulsion device comprising a propulsion unit including wall means defining a cavity, and a mounting member which is located in said cavity and which includes an outer shell engaging said wall means and an inner annular surface defining an axially extending bore, an inner core extending through said bore, being adapted to be connected to a kingpin, and including an outer annular surface, and annular resilient means connecting said inner and outer annular surfaces such that said resilient means is under compression in response to opposing axial forces on said inner core and said outer shell.

15. A marine propulsion device as set forth in claim 14 wherein said bore has a minimum diameter, wherein said inner core includes opposite end core portions, one of said end core portions having a diameter less than said minimum diameter, and a first conical portion converging inwardly from one of said end core portions, and wherein said resilient means includes an elastomeric member having a first portion disposed between said inner surface of said outer shell and said first conical portion and being deformable in both shear and compression responsive to axial movement of said inner core relative to said outer shell.

16. A marine propulsion device as set forth in claim 15 wherein said inner core includes a second conical portion converging inwardly from the other of said end core portions, and wherein said elastomeric member includes a second portion disposed between said inner surface of said outer shell and said second conical portion and being deformable in both shear and compression responsive to axial movement of said inner core relative to said outer shell.

17. A marine propulsion device comprising a propulsion unit including wall means defining a cavity, and a mounting member which is located in said cavity and which includes an outer shell engaging said wall means and including an annular inner surface defining an axially extending bore having a minimum diameter, an inner core extending through said bore, being adapted to be connected to a kingpin, and having opposite end portions, one of said opposite end portions having a diameter greater than said minimum diameter, and resilient means for connecting said inner core to said outer shell such that said resilient means is under compression in response to opposite axial forces on said inner core and said outer shell.

18. A marine propulsion device comprising a propulsion unit including a propeller shaft, an engine drivingly connected to said propeller shaft, wall means defining a cavity, and a mounting member which is located in said cavity and which includes an outer shell engaging said wall means and including an annular inner surface defining an axially extending bore, an inner core extending through said bore and being adapted to be connected to a kingpin, and resilient means for connecting said inner core to said outer shell such that said resilient means is under compression in response to opposing axial forces on said inner core and said outer shell.

19. A marine propulsion device comprising a propulsion unit including a propeller shaft, wall means defining a forwardly opening cavity, a mounting member which is located in said cavity and which includes an annular outer shell including an outer surface engaging said wall means and an inner surface defining an axially extending bore, said bore including a central surface portion having a minimum diameter, and forward and rearward surface portions each converging inwardly to said central surface portion, said forward and rearward surface portions respectively defining a forward frustoconical bore section and a rearward frustoconical bore section, an inner core extending through said bore, being adapted to be connected to a kingpin, and including a central core portion encircled by said central surface portion, a forward end core portion having a diameter less than said minimum diameter, a rearward end core portion having a diameter greater than said minimum diameter, extending externally of said bore, and providing interference between said outer shell and said inner core to prevent removal of said inner core from said outer shell in response to forces tending to move said inner core in a forward axial direction relative to said outer shell, a forward conical portion which converges from said forward end core portion to said central core portion and which is housed within said forward frustoconical bore section, and a rearward conical portion which converges from said rearward end core portion to said central core portion and which is housed within said rearward frustoconical bore section, and a resilient member which is bonded between said inner core and said inner surface of said outer shell and which includes a first portion disposed between said forward surface portion of said inner surface and said forward conical portion of said inner core, a second portion disposed between said rearward surface portion of said inner surface and said rearward conical portion of said inner core, each of said first and second portions of said resilient member being deformable in both shear and compression responsive to axial movement of said inner core relative to said outer shell, and a third portion disposed between said central surface portion of said inner surface and said central core portion, said third portion being deformable in shear responsive to axial movement of said inner core relative to said outer shell, and means for securing said mounting member in said cavity.

* * * * *